US006861249B1

(12) United States Patent
Kent

(10) Patent No.: US 6,861,249 B1
(45) Date of Patent: Mar. 1, 2005

(54) MICROBIAL SPRAY FOR ANIMAL WASTE

(76) Inventor: David Kent, 7378 Village Square Dr., West Bloomfield, MI (US) 48322

( * ) Notice: Subject to any disclaimer, the term of this patent is extended or adjusted under 35 U.S.C. 154(b) by 170 days.

(21) Appl. No.: 10/118,567

(22) Filed: Apr. 9, 2002

(51) Int. Cl.[7] ..... C12S 13/00
(52) U.S. Cl. ..... 435/262; 435/264; 435/307.1
(58) Field of Search ..... 71/6, 8, 21; 435/262.5, 435/262, 264, 283.1, 307.1, 309.1; 510/278–280, 191, 392, 393

(56) References Cited

U.S. PATENT DOCUMENTS

| | | | | |
|---|---|---|---|---|
| 4,485,971 A | | 12/1984 | Pajevic | |
| 5,593,888 A | | 1/1997 | Glaze et al. | |
| 5,975,095 A | | 11/1999 | Ahmed et al. | |
| 6,129,096 A | * | 10/2000 | Johnson | 134/34 |

FOREIGN PATENT DOCUMENTS

| | | | | |
|---|---|---|---|---|
| DE | 4421511 A1 | * | 12/1995 | A01K/23/00 |
| EP | 473889 A2 | * | 3/1992 | C05F/3/00 |
| FR | 2658077 A | * | 8/1991 | A61L/11/00 |
| GB | 2248452 A | * | 4/1992 | C11D/7/42 |
| JP | 05300933 A | * | 11/1993 | A61L/9/01 |

* cited by examiner

*Primary Examiner*—William H. Beisner
(74) *Attorney, Agent, or Firm*—Kirkpatrick & Lockhart Nicholson Graham LLP; Anthony H. Handal

(57) ABSTRACT

An appliance for accelerating the degradation of feces and other organic wastes is disclosed. The appliance comprises a container containing an accelerator to accelerate the breakdown of fecal wastes, and a transport mechanism for ejecting the accelerator from the container. The accelerator comprises a mixture of microorganism and free enzymes which are environmentally friendly and non-toxic.

28 Claims, 2 Drawing Sheets

MICROBIAL SPRAY FOR ANIMAL WASTE

STATEMENT REGARDING FEDERALLY SPONSORED RESEARCH OR DEVELOPMENT (Not applicable.)

BACKGROUND OF THE INVENTION

Organic excreta, whether from domestic, stray or wild animals, often has a substantial adverse impact on otherwise pleasant modem lifestyles. The same also represents a significant health threat, due to the plethora of diseases often found in animal excrement. While nature will, over time, degrade the organic components of excreta, such action is relatively very long-term. Moreover, while the same is occurring, excreta poses a health hazard, gives off unpleasant odors, and appears and is repulsive to most individuals. At the same time, solid excreta also present the possibility of being picked up underfoot and spread, sometimes even into the home, office or commercial environment. Finally, excreta while it is deteriorating naturally over a long period of time tends to damage lawns due to heat and other prolonged effects.

In an effort to avoid the dangers and unpleasantness associated with the same, numerous jurisdictions have implemented so-called "pooper scooper" laws which require, for example, a dog owner to clean up after a pet, for example, while it is being given its required daily walk. However, in addition to the fact that pet owners are not all fastidious about cleaning up after their animals, numerous sources of excreta, not controllable by pooper scooper regulations abound. These range from problems created by Canadian geese on golf courses and waterfront properties to the excreta of wild deer beside houses in the suburbs, and leavings of stray animals in urban locations.

SUMMARY OF THE INVENTION

While the above-mentioned action of nature integrating organic waste can be accelerated by the addition of bacterial agents, such as known bacterial spores, which in the presence of moisture and nutrition will emerge from the dormant state to an active bacterial phase to degrade the organic waste, in accordance with the present invention, the applicant herein has noted that prior approaches such as the collection of excreta and consolidation into a lagoon or other container, where the bacterial agent may be combined with the organic excreta, which one wishes to dispose, do little to remove the unpleasantness associated with the treatment of such materials.

Typically, such techniques only make sense in the case of large amounts of excrement such as would be found, for example, on a livestock farm, or other similar facility. The large amount of material involved makes it possible to use mechanized equipment to quickly and effectively move a large amount of material into a central area where the same can be efficiently treated. However, such an approach does not make sense in the case of the relatively low volume and low-density of animal excreta typically associated with residential non-farming animal excreta problems. Moreover, consumers do not usually have available to them a place where such bacterial degradation can be done. It is further, in accordance with the present invention, noted that, even in the event that a consumer wished to devote an area of his garden to the treatment of excreta, the concentration of excreta in a single place during the treatment of the excreta will result in one area for culturing disease and emitting smell.

Perhaps even more inconvenient is the fact that the same is a relatively complex process to implement, involving collection of excreta, transporting the same to a central area, loading the same into that area, and, finally, applying the material to accelerate organic degradation of the excreta.

The present invention has as its object a simple convenient process for dealing with animal excreta. The same is achieved without collection or transport of the excreta or even contact with the same, while at the same time greatly reducing the possibility of the same being spread either outside a building or into a structure. In accordance with the invention, the excreta are dispatched in an essentially one step process that is both environmentally friendly, convenient and relatively pleasant to implement.

More particularly, in accordance with the invention, excreta are dispatched through the use of an off-the-shelf appliance which may conveniently and unoffensively be stored in any location, from which it may be retrieved with a minimum of effort, used and replaced. At the same time, the appliance remains completely clean and pleasant to handle.

Bioaugmentation is the practice of enhancing the performance of indigenous microorganism populations of wastewater treatment systems through the addition of microorganism cultures with specific degradative abilities. This bioaugmentation improves the efficiency of the already present process of degradation of wastewater products by indigenous microorganisms. The microorganisms used for this process are selected to enhance microbial populations of an operating waste treatment facility to improve water quality and/or lower operation costs. Factors used in selecting the microorganisms, typically bacteria and fungi, include reproduction rates and ability of the microorganisms to perform specific functions in the degradation process. The bioaugmentative microorganism are sold as liquid or dried on a bran carrier.

Further, bioremediation is the use of selected microorganisms to accomplish a biological cleanup of a specified contaminated area, such as soil or water. This is performed for a finite project or area, not an ongoing process, such as bioaugmentation.

BRIEF DESCRIPTION OF THE DRAWINGS

One or more embodiments of the invention and of making and using the invention, as well as the best mode contemplated of carrying out the invention, are described in detail below, by way of example, with reference to the accompanying drawings, in which.

DETAILED DESCRIPTION OF THE INVENTION

Figure 1:
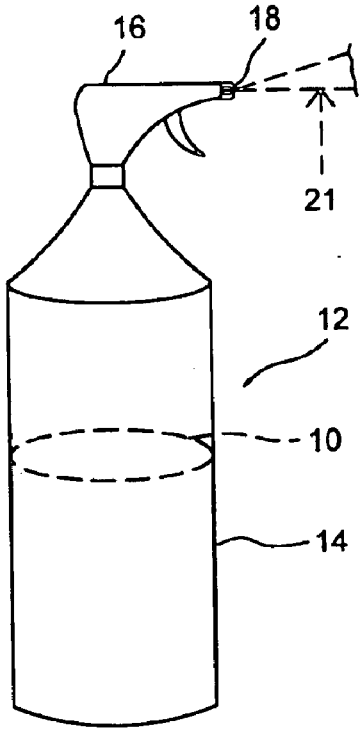
FIG. 1 is a front view of an embodiment of a spray bottle to be used in accordance with the present invention.
Figure 2:
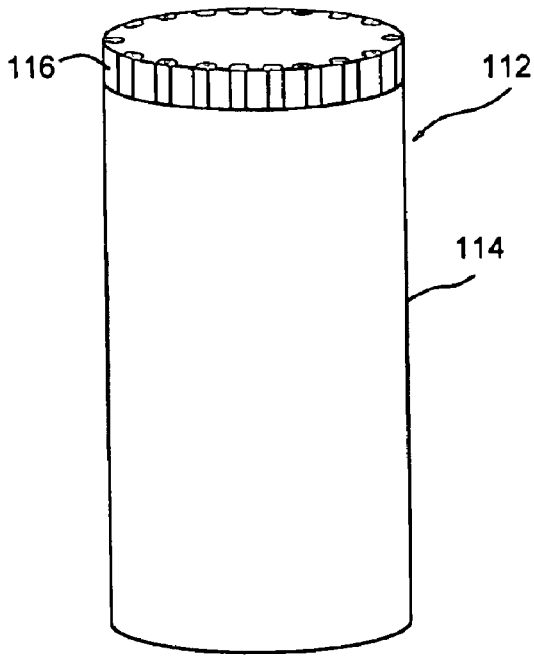
FIG. 2 is a front view of an embodiment of a sprinkle bottle for dry powder to be used in accordance with the present invention.
Figure 3:
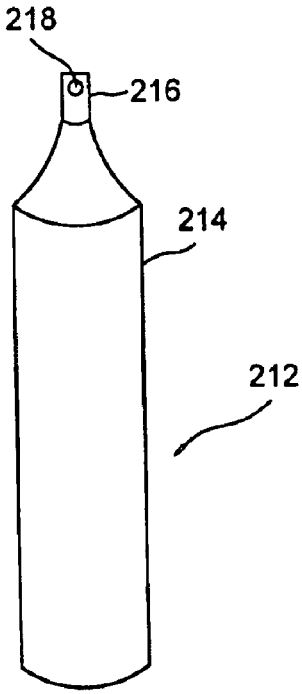
FIG. 3 is a front view of an embodiment of a pump bottle to be used in accordance with the present invention.

Referring to FIG. 1, in accordance with the invention, a waste degradation accelerator 10 contained in an applicator appliance 12 promotes the rapid breakdown of organic matter such as dog feces and other animal excreta. Such organic matter includes, even slow to degrade material within the feces, in an environmentally friendly manner. In the preferred embodiment, accelerator 10 is a liquid, made of organic materials that accelerates the natural degradation cycle of fecal wastes. In addition, the end products of the breaking of these wastes down are beneficial soil nutrients, that are essential for turf grass and plant growth. Further, accelerator 10 breaks the nutrients down into a form that is easily assimilated by the root system.

As will disclosed in more detail, the fecal waste is broken down into sugars, amino acids, and other nutrients such as calcium. The nutrients serve to nourish the soil on which the feces are sitting, and also are utilized by the fecal degrading bacteria present in accelerator 10 to increase the growth rate of the bacteria. The bacteria consume the organic compounds present in the fecal matter and convert them into carbon dioxide, water, nitrogen, potassium, phosphorus, and calcium, especially in the form of calcium carbonate and cellular energy in the form of adenosine triphosphate (ATP) and other related compounds, which foster reproduction of the bacteria, and at the same time, the inventive process changes odor producing substances to non-odor producing products, such as water, carbon dioxide and salts. Further, the bacteria present in accelerator 10 can also potentially compete with pathogens to attenuate their pathogenicity.

Accelerator 10 comprises a bacterial and enzyme formula suspended in a water carrier. A preservative such as ethylenediaminetetraacetic acid("EDTA") or germicide, such as a nipocide is added. The preservative serves to keep the intended bacteria of the product in a dormant, spore state, thus preventing germination, and prevent airborne bacteria from contaminating the solution. The amount of preservative used is the product of a delicate balance. Enough should be used to inhibit germination and contamination, but not so much as to kill the intended bacteria. Water makes up about 90% of the inventive accelerator 10.

The bacteria of accelerator 10 is of the bacillus variety. An accelerator material of the type supplied to the inventor herein by Apptec Inc., 4 Washington Drive, Cranbury, NJ 08512 is preferred. This accelerator 10 has a count of 54 billion bacteria per milliliter of accelerator 10 or 1.56 billion per ounce. A blend of bacilli of the thermophilic variety are used. Thermophilic bacteria grow best at high temperatures. Further, the bacilli are aerobic (use oxygen) and facultative anaerobic (aerobic bacteria that can also function, at least for a limited time, with little or no oxygen). The bacilli used are chosen for their extracellular enzyme activities. More specifically, the bacilli have cellulase, protease, lipase, and amylase activity to break down cellulose, proteins, fats and starches.

Aerobic bacteria, bacilli in the present invention, consume nutritionally 15 to 30 parts carbon for each part nitrogen. The preferred embodiment of the present invention works best with a carbon/nitrogen ratio of 30 or less, which, under normal circumstances is the natural ratio in most animal feces. This ratio being favorable for rapid degradation of the fecal matter.

Further, the bacilli of the present invention are spore forming. This allows the dormant spore bacterial colonies in the applicator 12 to withstand unfavorable conditions of heat, cold, pH, and certain chemicals, providing a long shelf life for the products. For example, containing such spores in the wild or in certain countries before consuming water, Water must be boiled for at least 5–10 minutes. Anything less might allow spore forming bacteria to survive.

The other major component of accelerator 10 is a quantity of free enzymes which serve to start the breakdown process of the feces. More specifically, these enzymes include: proteases, amylases, cellulases and lipases.

Protease breaks down proteins into peptides (short chains of amino acids) and free amino acids. These peptides and free amino acids serve as a nitrogen sources for the bacteria to foster the feces degradation.

Acceleration 10 comprises ingredients from a class of enzymes known as amylases which hydrolyze starchy materials into glycogen and disaccharides. Cellulases are also included in acceleration 10 to break down cellulose, a complex carbohydrate and the main structural component of cell wall material, into its shorter poly- and monosaccharides constituents, making them more bio-available to the bacteria and the soil. The final class of enzymes used as ingredients for acceleration 10 are the lipases which break down fats into fatty acids and glycerols.

A surfactant may also be included in accelerator 10. The surfactant serves to reduce the surface tension of the substrate, which in this case is the feces, causing it to emulsify, break into smaller particles with less adhesion between the particles. This emulsification makes the feces more bio-available to the bacteria, by allowing its particles to pass through the cell wall of the bacilli, so the bacilli can digest it.

Accelerator 10 is made of a mixture of approximately 10% bacteria, free enzymes, surfactant, fragrance, dyes and inert ingredients and approximately 90% water. This combination has a specific gravity of about 1.05, and a cloudy dark amber colored appearence. Accelerator 10 has a boiling point of approximately 100° C. and a freezing point of −1° C. Accelerator 10 has a pH of approximately 7.

The biologic activity of accelerator 10, although very stable, can be affected by prolonged exposure to adverse temperature and pH. The preferred embodiment of accelerator 10 functions best in a temperature range of 3.33° C. to 62.8° C. (38° F. to 145° F.). Temperatures above 63° C. have been shown to inactivate the biologic cultures used in accelerator 10. The functional pH range for accelerator 10 is 5 to 9.8.

Very strong acids and bases can deactivate the biologic cultures. Accelerator 10 has not been shown to be sensitive to light.

These broad ranges of temperature and pH are made possible by the spore status of the bacilli. This leads to a shelf life of accelerator 10 of approximately two years when kept in a cool, dry place. The preferred embodiment is best stored at 1.7° C. to 95° C. (35° F. to 95° F.).

Accelerator 10 is environmentally friendly. All of the ingredients of accelerator 10 are biodegradable and nontoxic, making it safe for use around plants, animals, humans. Accelerator 10 has been shown not to harm aquatic life, so it can be used near bodies of water. Further, as accelerator 10 breaks down the feces, it does not produce any air polluting volatile organic compounds (VOC's).

Despite the environmental friendliness of accelerator 10, it can cause eye and skin irritation with contact. Therefore, eye protection is recommended to be worn by the user. Should eye or skin contact occur, the user should wash the skin with ordinary soap and water, and should flush his eyes with water for fifteen minutes.

Although accelerator 10 does produce skin irritation, not enough is absorbed through skin to result in any toxic effect. If accelerator 10 is ingested, it can cause some abdominal pain, nausea and vomiting, although most of the types of constituents of accelerator 10 are present in the human gastrointestinal tract. Accelerator 10 is not a known inhalation hazard, but inhalation should be avoided nonetheless. Accelerator 10 is safe enough to use in a normally ventilated room.

In the preferred embodiment, accelerator 10 will be supplied from a applicator 12, such as a common spray bottle, as is illustrated in FIG. 1. In the preferred embodiment, the spray bottle 12 may be opaque to hide the unattractive dark amber color. Spray bottle 12 is made of a vessel 14, attached to vessel 14. Attached to vessel 14 is a sprayer head 16. Sprayer head 16 is attached to vessel 14 by any means common in the art, such as threading. Sprayer head 16 has a nozzle portion 18 and a trigger portion 20. When trigger portion 20 is squeezed, accelerator 10 is dispensed through nozzle 18.

The spraying action of accelerator 10 forms the accelerator into a jet 21 which may be as long as one, two or three meters long, or longer by applying substantial force to liquid accelerator 10, giving it considerable momentum when the jet of accelerator impacts on the feces, this provides for a mechanical breakdown of the feces, assisting the surfactants in the emulsification of the feces, making it more bio-available to the bacteria by breaking larger chunks into smaller ones and increasing the surface area of the feces for increased bio-activity. The use of a long jet allows the user to apply the material while standing at a relatively remote point from the feces to be dispatched.

After spraying, the free enzymes are the first to act after the surfactants on the feces. As the enzymes break down their respective targeted components and to a lesser extent other components, this provides food for the bacteria. When ample food and water are present, the bacilli come out of the spore state and begin to germinate and feed on the feces nutrients. With the continued action of the surfactant, free enzymes, bacteria and enzymes produced by the bacteria, the feces is broken down, and the nutrients are returned to the soil.

In a petri dish and on turf grass, under ideal conditions of temperature, humidity and light, accelerator 10 will increase degradation time from approximately 10 to 15 days to 3 to 4 days, with emulsification occurring within approximately 24 hours. Additionally, accelerator 10 will provide nutrients from the feces to the turf grass which in turn strengthens the grass by increasing its root mass.

In use, the user keeps the inventive spray bottle 12 on the shelf or in another convenient place and transports it to the location where it is to be used. At that location sprayer head 16 is aimed at feces to be dispatched and squeezes the trigger 20 to send a quantity of accelerator to the feces.

In an alternative embodiment of accelerator 10, nitrogen can be added to the mixture. In the preferred embodiment, the nitrogen source is urea, which turns the mixture a dark brown. The nitrogen prevents nitrogen depletion of the bacilli from limiting the degradation rate of the fecal matter. Under conditions where nitrogen is depleted, such as with nitrogen deficient soil, or under composting conditions, applications addition of nitrogen is desirable. Further, the addition of nitrogen helps further support the root structure of the vegetation under and around where the feces is deposited.

In another alternative embodiment of the present invention, an odor eliminating compound can be added to accelerator 10. This odor eliminating compound can be of a type that is zinc based, or a material in the odor neutralizing class. The zinc based odor eliminating compounds form a molecular cage around the odor forming component of the feces, reducing or substantially eliminating the inherent smell of the matter. Although zinc can have an inhibitory effect on bacteria, in the present embodiment, the zinc compounds are used in very low doses which have been shown not to have adverse effect on the bio-activity of accelerator 10.

One may also apply odor neutralizing compounds, such as the one sold by Apptec under the name N100, in accelerator 10 to convert a compound to an odorless salt, thus eliminating the odor of the matter.

In another alternative embodiment of the present invention, an odor masking component can be added to accelerator 10. The surfactants of accelerator 10 serve to suspend the odor masking component in solution. These odor masking components can be from a mixture of natural or synthetic fragrant oils or extracts or mixtures thereof, producing a pleasant aroma, such as fresh scent, or herbal scent.

In a further alternative embodiment, dye or pigments can be added to accelerator 10.

When accelerator 10 is sprayed, it marks the feces with a visible color or white so people do not step in the feces during the inventive degradation process. Additionally, a photo-luminescent dye can be used to make the degrading feces visible under low light conditions. Since the dye or pigment relies on the structured integrity of the feces, when the dye or pigment is not visible, the feces is substantially totally degraded.

In yet another alternative embodiment, accelerator 110 can be dehydrated forming a powder that can be sprinkled using a sprinkle bottle 112 on the feces. The natural moisture of the feces reconstitutes the accelerator, making it bio-active. If the feces is dehydrated, it may be beneficial to spray water on the feces with the application of the dehydrated accelerator 10. Sprinkle bottle 112 is generally comprised of a vessel portion 114 and a sprinkling head 116. Sprinkling head 116 containing multiple holes to allow accelerator 110 to flow through Further, rotation of head 116 on vessel 114 will cause holes 118 to open and close.

Additionally, the dehydrated accelerator 10 can be sold in a powder form, and reconstituted by the user in their home. For example, the user may add the dehydrated accelerator 10 to a spray bottle, then add a defined amount of water, reconstituting the accelerator, and making it ready for use.

Alternatively, accelerator 10 can be distributed in an pump bottle 212. In the present embodiment, the pump bottle 212 is optionally opaque to hide the unpleasant dark amber color. Pump bottle 212 is made of a vessel 214. Attached to vessel 214 is a sprayer head 216. Sprayer head 216 has a nozzle portion 218. When head 216 is pressed toward vessel 214, accelerator 10 is dispensed through nozzle 218.

Figure 4:
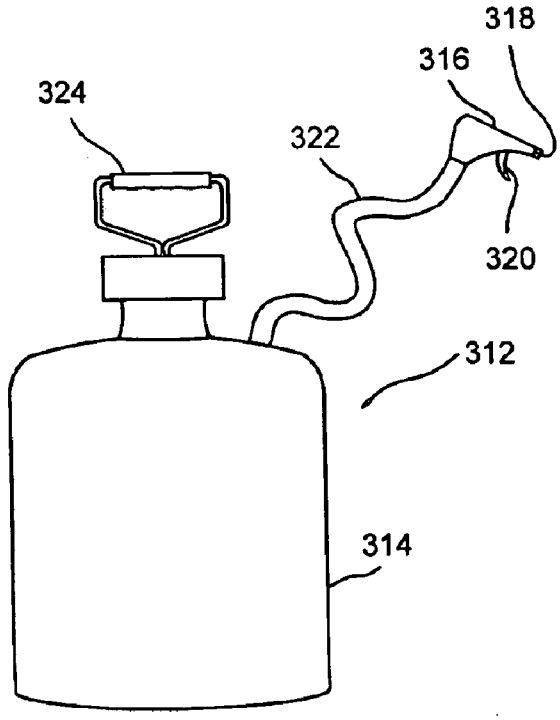
FIG. 4 is a front view of an embodiment of a garden sprayer of the type that a user can pressurize the tank such that the liquid contained within the tank can be sprayed using that force, said garden sprayer to be used in accordance with the present invention.
Figure 5:
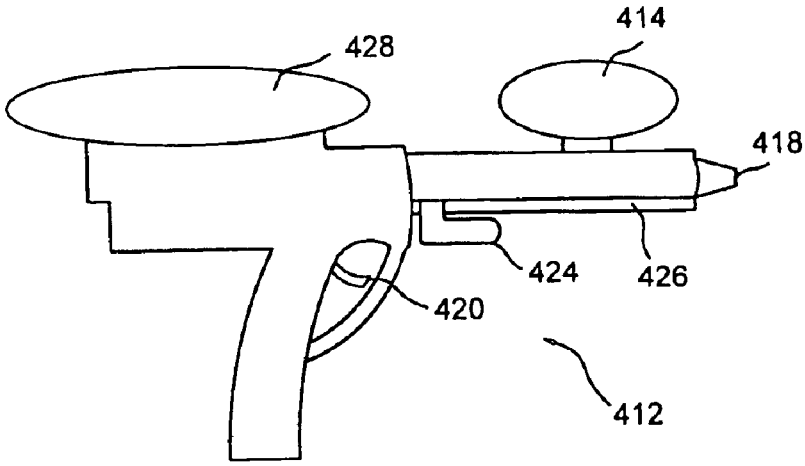
FIG. 5 is a front view of an embodiment of a pressurized spray gun of a type commonly used by children in play, a user can pressurize an air bladder such that the liquid contained within a tank can be sprayed using the force from the air bladder and sprayed for long distances, said spray gun to be used in accordance with the present invention.

Alternatively, accelerator 10 can be distributed in a garden sprayer 312, as is illustrated in FIG. 4. In the present embodiment, the garden sprayer 312 is optionally opaque to hide the unpleasant dark amber color. Garden sprayer bottle 312 is made of a vessel 314, attached to vessel 314 is a sprayer head 316. Sprayer head 316 is attached to vessel 314 by way of a hose 322. Sprayer head 316 has a nozzle portion and a trigger portion 320. Vessel 314 has a pump handle 324 attached. As pump handle 324 is moved toward and away from vessel 314, air is pumped into vessel 314 creating pressure. When trigger portion 320 is squeezed, accelerator 310 is dispensed through nozzle 318 using the pressure created by handle 324.

Alternatively, accelerator 10 can be distributed in a high pressure pump sprayer 412, such as those played with by children and sold under the trademark SUPER SOAKER. Pump sprayer 412 is made of a vessel 414 which holds accelerator 10. As a user would move pump handle 424 back and forth, pressure is created in an air bladder 428. When trigger 420 is squeezed, accelerator 410 is dispensed through nozzle 418 using the pressure from bladder 428. This is useful when the user needs to spray at a distance. Such an application is that of a farmer spraying onto a pile of feces, while the farmer is on his tractor.

Figure 6:
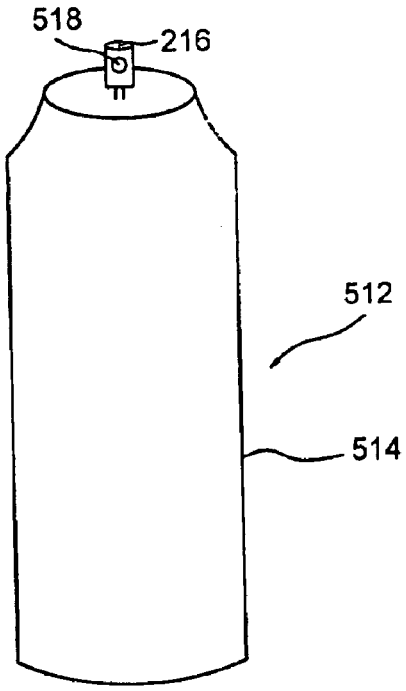
FIG. 6 is a front view of an embodiment of an aerosol spray can to be used in accordance with the present invention.

Alternatively, accelerator 10 can be distributed in an aerosol bottle 512, as is illustrated in FIG. 6. In the present embodiment, the aerosol bottle 512 is optionally opaque to hide the unpleasant dark amber color. Aerosol bottle 512 is made of a vessel 514, attached to vessel 14 is a sprayer head 516. Sprayer head 516 is attached to vessel 514 by any means common in the art Sprayer head 516 has a nozzle portion 518. When head 516 is pressed toward vessel 514, accelerator 510 is dispensed through nozzle 518, using the force generated by a propellant added to vessel 514 at the time of manufacture.

Figure 7:
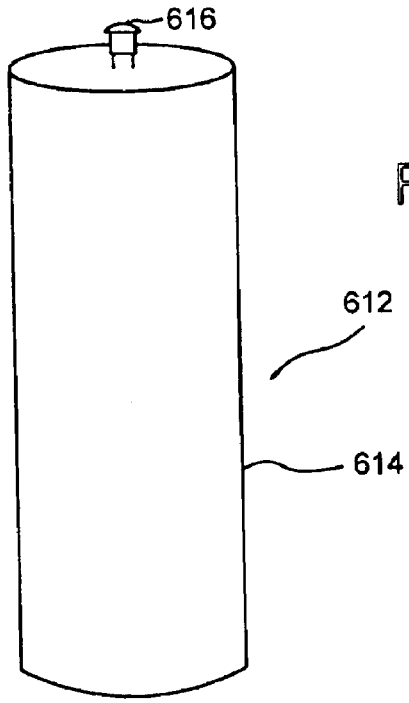
FIG. 7 is a front view of an embodiment of a liquid sprinkle bottle to be used in accordance with the present invention.
Figure 8:
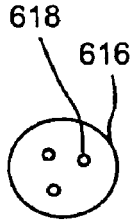
FIG. 8 illustrates a top view of the sprinkle head of the sprinkle bottle of FIG. 7.

Alternatively, a liquid accelerator 10 can be distributed in a sprinkle bottle 612 as is illustrated in FIG. 7. In the present embodiment, the sprinkle bottle 612 is optionally opaque to hide the unpleasant dark amber color. Sprinkle bottle 612 is made of a vessel 614. Attached to vessel 614 is a sprinkle head 616. Sprinkle head 616 is attached to vessel 614 by any means common in the art. Sprinkle head 616 has a hole portion 618. When a user shakes the sprinkle bottle 612, accelerator 10 is dispensed through hole portion 618.

It is further conceived that dispensers of the inventive accelerator can be sold in vending machine in areas where dogs are commonly walked, such as city parks.

In the description, reference is made to the accompanying drawings, which form a part hereof, and which illustrate examples of the invention. Such examples, however, are not exhaustive of the various embodiments of the invention, and therefore, reference is made to the claims which follow the description for determining the scope of the invention. While illustrative embodiments of the invention has been described, it is, of course, understood that various modifications of the invention will be obvious to those of ordinary skill in the art. Such modifications are within the spirit and scope of the invention which is limited and defined only by the appended claims.

I claim:

1. An appliance for accelerating the degradation of a deposit of feces and other organic wastes comprising:

(a) a container configured and dimensioned to be carried by an individual and defining an internal volume;

(b) a liquid accelerator disposed in said internal volume of said container, said liquid accelerator comprising i) one or more materials selected from the group consisting of living organisms having the characteristic of breaking down feces by biological activity, and non-living materials with chemical activity when combined with feces which react with components of feces generating altered components which foster biological metabolization and microbial reproduction, and ii) a dye or pigment; and (c) a transport mechanism adapted to be grasped and squeezed by the hand of a user to eject said liquid accelerator from said internal volume of said container.

2. An appliance as claimed in claim 1 wherein said container is plastic.

3. An appliance as claimed in claim 1 wherein said container is glass.

4. An appliance as claimed in claim 1 wherein said container is opaque.

5. An appliance as claimed in claim 1 wherein said accelerator comprises enzymes.

6. An appliance as claimed in claim 5 wherein said enzymes are proteases, cellulases, lipases and amylases.

7. An appliance as claimed in claim 1 wherein said accelerator comprises enzymes and bacteria spores.

8. An appliance as claimed in claim 7 wherein said bacteria spores are bacilli.

9. An appliance as claimed in claim 1 wherein said transport mechanism is an aerosol sprayer.

10. An appliance as claimed in claim 1 wherein said transport mechanism is a pump sprayer, said deposit of feces having a physical shape and said pump sprayer ejecting liquid accelerator with sufficient force to result in altering the physical shape of said deposit of feces and increasing the surface area of the deposit of feces exposed to oxygen in the air and covered with said liquid accelerator to result in an increased degradation rate for said deposit of feces.

11. An appliance as claimed in claim 1 wherein said transport mechanism is a sprinkle bottle.

12. An appliance as claimed in claim 1 wherein said transport mechanism is a pressurized liquid ejection device coupled to a garden hose, wherein the pressure of water passing through said garden hose draws said liquid accelerator and mixes said liquid accelerator with water in an output from said garden hose to eject toward said deposit of feces the accelerator for accelerating biologically the degradation of said deposit.

13. An appliance as claimed in claim 1 further comprising a nitrogen source.

14. An appliance as claimed in claim 13 wherein said nitrogen source is urea.

15. An appliance as claimed in claim 1 further comprising a preservative.

16. An appliance as claimed in claim 15 wherein said preservative is ethylenediaminetetraacetic (EDTA).

17. An appliance as claimed in claim 1 wherein said liquid accelerator comprises Nipacide.

18. An appliance as claimed in claim 1 wherein said dye is photo-luminescent.

19. A method for using an accelerator contained in an appliance for accelerating the degradation of a deposit of feces and other organic wastes comprising:

(a) a container configured and dimensioned to be carried by an individual and defining an internal volume;

a liquid accelerator disposed in said internal volume of said container, said liquid accelerator comprising one or more materials selected from the group consisting of living organisms having the characteristic of breaking down feces by biological activity, and non-living materials with chemical activity when combined with feces which react with components of feces generating altered components which foster biological metabolization and microbial reproduction; and (c) a transport mechanism adapted to be grasped and squeezed by the hand of a user to eject said liquid accelerator from said internal volume of said container, said method comprising the steps of:

(d) filling said container with various ingredients, said ingredients forming said liquid accelerator;

(e) transporting said container, (f) storing said container;

(g) transporting said container to location of use; and (h) applying said liquid accelerator to a deposit of organic waste at a location where said organic waste has been deposited by an animal without changing the location of said organic waste.

20. A method of using the liquid accelerator as claimed in claim 19 wherein said applying is performed by spraying an aerosol containing said liquid accelerator.

21. A method of using the liquid accelerator as claimed in claim 19 wherein said applying is performed by squeezing a handle to spray said liquid accelerator from a spray bottle.

22. A method of using the liquid accelerator as claimed in claim 19 wherein said applying is performed by spraying from a pump bottle.

23. A method of using the liquid accelerator as claimed in claim 19 wherein said applying is performed by spraying from a pressurized liquid ejection device.

24. A method of using the liquid accelerator as claimed in claim 19 wherein said applying is performed by spraying from a distance from the organic waste.

25. A method of using the liquid accelerator as claimed in claim 19 wherein said applying is performed by spraying from a distance from on top of a vehicle, such as a tractor.

26. A method of using the liquid accelerator as claimed in claim 19 wherein said applying comprises applying aid to a mixed with said accelerator for visually marking said organic waste.

27. A method of using the liquid accelerator as claimed in claim 19 further comprising the step of:

(i) repeating steps (f), (g) and (h).

28. An appliance for accelerating the degradation of a deposit of feces and other organic wastes comprising:

(a) a container configured and dimensioned to be carried by an individual and defining an internal volume;

(b) a liquid accelerator disposed in said internal volume of said container, said accelerator comprising i) one or more materials selected from the group consisting of living organisms having the characteristic of breaking down feces by biological activity, and nonliving-materials with chemical activity when combined with feces which react with components of feces generating altered components which foster biological metabolization and microbial reproduction, and ii) a dye or pigment; and (c) a transport mechanism for transporting said liquid accelerator from said internal volume of said container.

* * * * *